US009379441B2

(12) United States Patent
Martek et al.

(10) Patent No.: US 9,379,441 B2
(45) Date of Patent: Jun. 28, 2016

(54) VERY WIDE BAND TACTICAL VEHICULAR ANTENNA SYSTEM

(71) Applicant: Shakespeare Company, LLC, Columbia, SC (US)

(72) Inventors: Gary A. Martek, Blythewood, SC (US); John Maynard, Atlanta, GA (US)

(73) Assignee: Shakespeare Company, LLC, Columbia, SC (US)

( * ) Notice: Subject to any disclaimer, the term of this patent is extended or adjusted under 35 U.S.C. 154(b) by 375 days.

(21) Appl. No.: 13/898,530

(22) Filed: May 21, 2013

(65) Prior Publication Data

US 2013/0307748 A1 Nov. 21, 2013

Related U.S. Application Data

(60) Provisional application No. 61/649,706, filed on May 21, 2012.

(51) Int. Cl.

| | |
|---|---|
| ***H01Q 5/321*** | (2015.01) |
| ***H01Q 21/30*** | (2006.01) |
| ***H01Q 21/28*** | (2006.01) |
| ***H01Q 5/50*** | (2015.01) |
| ***H01Q 9/36*** | (2006.01) |
| ***H01Q 1/32*** | (2006.01) |

(52) U.S. Cl.

CPC ..... *H01Q 5/321* (2015.01); *H01Q 5/50* (2015.01); *H01Q 9/36* (2013.01); *H01Q 21/28* (2013.01); *H01Q 21/30* (2013.01); *H01Q 1/3275* (2013.01)

(58) Field of Classification Search

CPC ..... H01Q 5/321; H01Q 5/50; H01Q 9/36; H01Q 1/085; H01Q 21/28; H01Q 21/30; H01Q 1/3275; H01Q 5/335; H01Q 9/30

See application file for complete search history.

(56) References Cited

U.S. PATENT DOCUMENTS

| | | | | |
|---|---|---|---|---|
| 6,429,821 | B1 * | 8/2002 | Lewis, Jr. | 343/749 |
| 7,187,335 | B2 * | 3/2007 | Vincent | 343/722 |
| 7,855,693 | B2 * | 12/2010 | Martek et al. | 343/773 |
| 2008/0246679 | A1 * | 10/2008 | Martek et al. | 343/793 |

* cited by examiner

*Primary Examiner* — Robert Karacsony
(74) *Attorney, Agent, or Firm* — Michael J. Corrigan

(57) ABSTRACT

An antenna system includes a first antenna portion operating over a first range of frequencies, a second antenna portion operating over a second range of frequencies and an antenna matching network that receives a transmission line which includes a single conductor and a coaxial cable. The coaxial cable has an inner conductor insulated from an outer conductor, wherein the first antenna portion is fed by the single conductor and the outer conductor, and the second antenna portion is fed by the inner conductor.

19 Claims, 5 Drawing Sheets

VERY WIDE BAND TACTICAL VEHICULAR ANTENNA SYSTEM

CROSS-REFERENCE TO RELATED APPLICATIONS

This application claims priority of U.S. Provisional Application Ser. No. 61/649,706 filed May 21, 2012, which is incorporated herein by reference.

TECHNICAL FIELD

The present invention relates generally to antennae used in mobile/portable fixed and/or military applications. More particularly, the present invention relates to a broad band antenna system that provides an instantaneous bandwidth of about 500 Megahertz (MHz) between 30-512 MHz and additionally 300 to 2700 MHz high gain antenna function with an instantaneous bandwidth of 2500 MHz with a relatively low voltage standing wave ratio (VSWR) and high gain, using one vehicular antenna mounting position. Specifically, the antenna system provides a "VHF" portion and a L-Band portion that utilizes a low loss coaxial transmission line to pass through the VHF portion for connection to the antenna.

BACKGROUND ART

It is known that electromagnetic communication systems employ broad bandwidth techniques, such as the so-called frequency-agile or frequency-hopping systems in which both the transmitter and receiver rapidly and frequently change communication frequencies within a broad frequency spectrum in a manner known to both units. When operating with such systems, antennas having multiple matching and/or tuning circuits must be switched, whether manually or electronically, with the instantaneous frequency used for communications. As such, it is imperative to have a single antenna reasonably matched and tuned to all frequencies throughout the broad frequency spectrum of interest. Although the art discloses such broad-band antennas, these antennas suffer from a somewhat limited frequency range.

The user therefore has to use a plurality of antennas distributed all over the vehicle platform to be able to use the entire radio frequency spectrum. To minimize the number of antennas, a method is needed to encompass all these antenna functions in a single antenna system occupying a single antenna mounting location. The challenge is to vertically stack one on top of the other, feed signals to each, and electrically isolate the entire assemblage of co-located antenna elements.

U.S. Pat. No. 6,429,821 entitled Low Profile, Broad Band Monopole Antenna With Inductive/Resistive Networks and U.S. patent application Ser. No. 13/383,271 entitled Low Profile, Broad Band Monopole Antenna With Heat Dissipating Ferrite/Power Iron Network And Method For Constructing The Same, both of which are incorporated herein by reference, describe antennas with 25 to 512 MHz antenna functions. U.S. Pat. No. 7,855,693 entitled Wide Band Biconical Antenna With A Helical Feed System, which is also incorporated herein by reference, describes an antenna with a 300 to 2700 MHz antenna function utilizing a helical feed system. However, no known antenna system provides functionality over radio frequency bands covering 30 to 512 MHz, and 500 to 2500 MHz separately as two signal input ports at the base of the antenna. Therefore, there is a need in the art for an antenna system which combines the aforementioned antenna functions into a single antenna system occupying one antenna position on a vehicle while inherently providing an elevated position for a VHF/L-Band element array.

SUMMARY OF THE INVENTION

In light of the foregoing, it is a first aspect of the present invention to provide a very wide band tactical vehicular antenna system.

Another object of the invention is to provide an antenna system comprising a first antenna portion operating over a first range of frequencies, a second antenna portion operating over a second range of frequencies, and an antenna matching network receiving a transmission line comprising a single conductor and a coaxial cable, the coaxial cable having an inner conductor insulated from an outer conductor, wherein the first antenna portion is fed by the single conductor and the outer conductor, and the second antenna portion is fed by the inner conductor.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
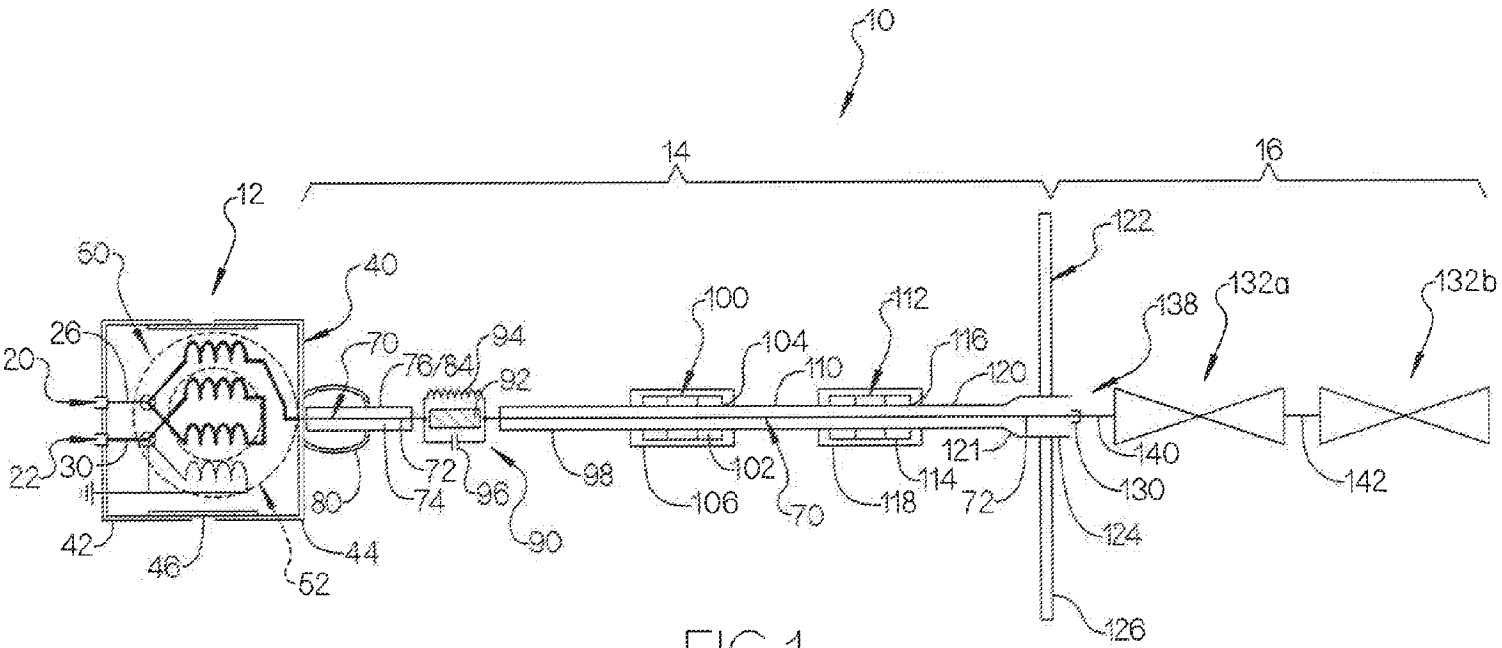
FIG. 1 is a schematic diagram of an antenna system made in accordance with the concepts of the present invention.
Figure 2:
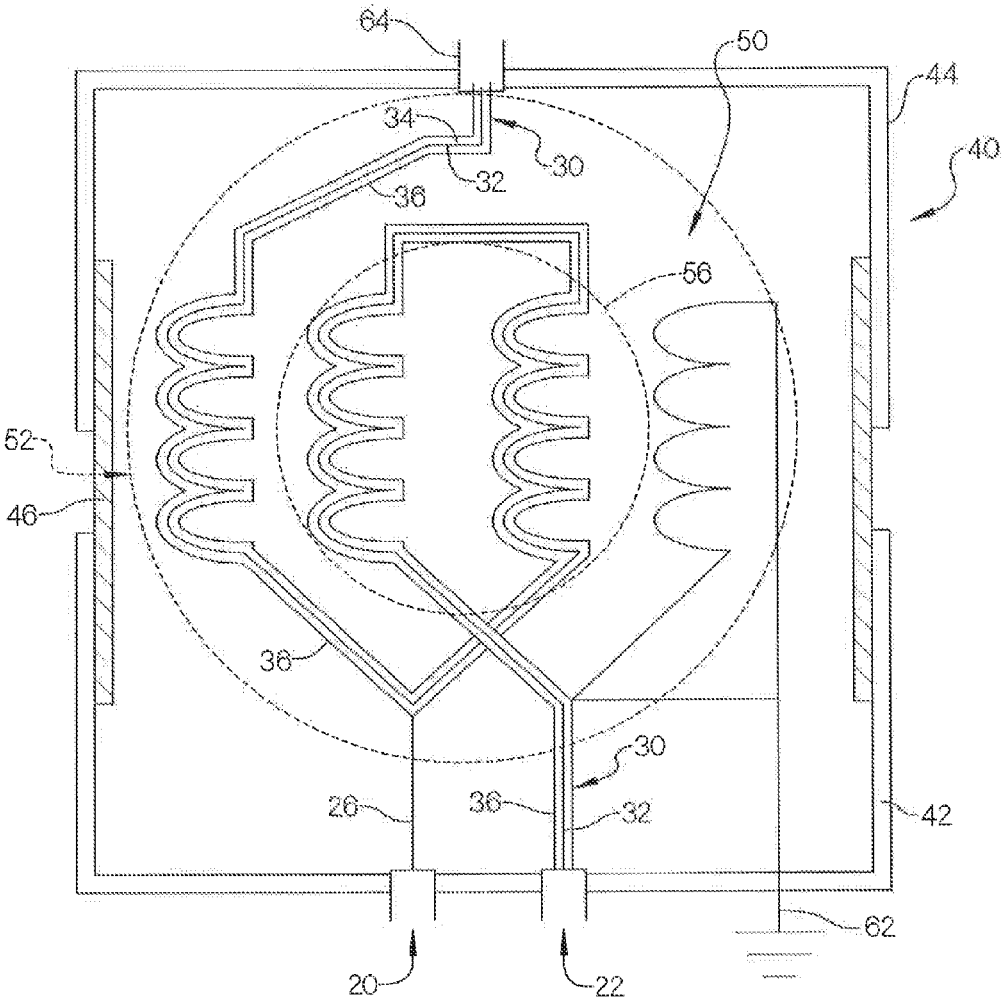
FIG. 2 is a detailed view of an antenna matching network utilized in the antenna system according to the concepts of the present invention.

Referring now to the drawings and in particular to FIGS. 1 and 2, it can be seen that a very wide band tactical vehicular antenna system according to the concepts of the present invention is designated generally by the numeral 10. The antenna system 10 is envisioned to be used with military vehicles or the like but it will be appreciated that the concepts of the disclosed antenna may be incorporated into any antenna system used on any type of platform. For example, the antenna disclosed herein may be employed for ground-to-ground, ground-to-air communications and for satellite communication.

The antenna system 10 includes three major components. An antenna matching network 12 is coupled to the electronic communications equipment (not shown) which is configured to emit and receive signals as appropriate. Extending from the network 12 is a VHF/UHF antenna portion 14 from which further extends a L-Band antenna portion 16. As will become apparent as the detailed description proceeds, the "VHF/UHF" portion of the antenna may use parallel inductor/capacitor or inductor/resistor networks and/or ferrite beads so as to obtain a desired performance. Moreover, the antenna system provides for allowing a low loss coaxial transmission line to pass through a combination of networks consisting of either capacitor/inductor, resistor/inductor, or ferrite beads for connection to the L-Band antenna portion. As used herein, the VHF/UHF band includes frequencies ranging from 30 to 512 MHz and the L-Band includes frequencies ranging from 500 to 2500 MHz. However, skilled artisans will appreciate that the above frequency bands may be enlarged or narrowed as needed for a particular end use.

Figure 1A:
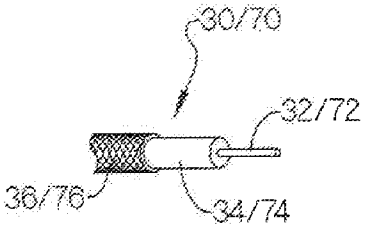
FIG. 1A is a detailed view of a coaxial cable used in the antenna system.

The antenna matching network 12 receives two inputs. The first input is a VHF/UHF input 20 and the second input is an L-Band input 22. The input 20 is an insulated conductor 26 while the input 22 is a coaxial cable 30. The coaxial cable 30, as seen in FIG. 1A, has an inner conductor 32 surrounded by an insulator 34. As skilled artisans will appreciate an outer conductor 36, which may be in the form of a braid as shown as FIG. 1A, surrounds the insulator 34. The outer conductor 36 may or may not have an insulating jacket that encloses the entire cable 30. Skilled artisans will appreciate that the insulated conductor 26 and the coaxial cable 30 pass into the antenna matching network 12.

The antenna matching network 12 provides a housing 40 which includes a conductive ground portion 42 split or separated from an output portion 44 by a housing insulator 46. The housing insulator 46 may be made of fiberglass or other insulating materials such that electrical signals cannot pass from the ground portion 42 to the output portion 44. Maintained within the housing 40 is an unbalanced-unbalanced (unun) matching transformer 50 which connects the inputs 20 and 22 and their associated conductors to an output that will be discussed. In one embodiment, the transformer 50 is a Guanella 1:4 unun transmission line transformer. The transformer 50 transforms the feed point impedances of the antenna to impedances that meet the VSWR operational requirements of the antenna system 10. The transformer 50 includes a ferrite core 52 which is torroidal in shape. The ferrite core 52 has an opening 56 extending therethrough. Also included within the antenna matching network 12 is a ground wire 62. As best seen in FIG. 2, the conductor 26 from the VHF/UHF input 20 is electrically connected to the outer conductor 36 of the input 22. Additionally, the ground wire 62 is also connected to the ground portion 42. The ground wire 62 is inserted into the opening 56 and wrapped a selected number of times around the ferrite core 52, connected to the outer conductor 36 as seen in FIG. 2, and then re-connected to the ground portion 42. The coaxial cable 30 and the electrically connected conductor 26 are inserted into the opening 56 and wrapped around the ferrite core 52 a selected number of times so as to obtain the desired electrical performance. The coaxial cable 30 then extends out the output portion 44 through an output port 64.

A coaxial output conductor 70, which is constructed the same as conductor 30, extends from the output port 64 into the first antenna portion 14. The output conductor 70 includes an inner conductor 72, which effectively carries the L-Band signal, an insulator 74 surrounding the inner conductor 72, and an outer conductor 76 surrounding the insulator 74 which carries the VHF/UHF band signal on its outer surface. It will be appreciated that the L-Band frequencies are effectively hidden from the operation of the VHF/UHF band and as such have no effect one way or the other on the operation of the first antenna portion 14. The inner conductor 32 of the coaxial cable 30 is accessed via the "L-Band input Port" which allows an L-Band signal to transport to the top "L-Band Output Port" The outer conductor surface 36 of this same coaxial cable 30 provides for the original transformer function. The input VHF/UHF signal is applied to the VHF/UHF Input Port and attaches to the outside surface of the coaxial shield or outer conductor 36 with a simple solder junction. The "transformed" VHF/UHF signal on the outer conductor 36 is available at the top of the transformer windings and is attached to the top insulated conductor housing 44 of the housing body 40.

The top and bottom of the transformer housing 40 is separated by a necessary insulator 46 that isolates the bottom grounded portion 42 of the antenna 10 from the top of the impedance transformer 50, this is necessary for the proper functioning of the VHF/UHF portion 14 of the antenna 10. The passage of the L-Band signal and its attendant coaxial cable is "invisible" to the transformer 50.

Also extending from the output portion 44 is a mobile shock spring 80. The shock spring 80 serves to provide strain relief to the first and second antenna portions 14, 16 so as to allow the antenna portions 14, 16 to sway or be deflected during operation and to maintain the integrity of the connection between the various conductors and the associated electronic equipment.

The VHF/UHF portion 14 of the antenna system 10 includes a hollow radiator 84 which is a tube-like configuration that internally receives the output conductor 70. It will be appreciated that the radiator 84 is electrically conductive and may be made of a material such as brass. The outer conductor 76 is electrically connected to the radiator 84 and an electrical connection may be maintained internally within the tube by a secure solder connection and/or other mechanical-type connection that maintains electrical conductivity.

Connected to an end of the radiator 84 opposite the housing 12 is a tank circuit 90. The tank circuit 90 includes a cylindrically-shaped insulator 92 which is constructed of a non-conductive material. The output conductor 70 exits the radiator 84 and is helically wrapped a selected number of times around the insulator 92 so as to effectively form an inductor 94. The inductor 94 is created by forming a coiled outer conductor 76. Inclusion of a capacitor 96 with the inductor 94 creates the tank circuit 90, wherein the capacitor 96 is connected in parallel across the coils formed around the cylindrical insulator 92. The output conductor 70 is then received in another linear radiator 98 which is also constructed in a manner similar to the radiator 84. Skilled artisans will appreciate that the coaxial cable leaving the top of the transformer housing passes through the tank circuit 90. The coaxial cable 30 which contains the L-Band signal is used to form the inductor part of the tank circuit 90 by the use of its outside shield 36 as in the case of the transformer 50 described above. Tank circuits are used to isolate portions of the antenna when specific frequency bands are used. Skilled artisans will appreciate that the L-Band signals are not affected by the tank circuit 90 aside from a slight loss in the coiling of the conductor 70. The outer conductor 36 of the coaxial cable 30 is also soldered to the entry and exit points of the radiators it traverses.

Extending axially from the tank circuit 90 are a series of linear radiators and electrical component networks which function in such a manner that as the frequency of operation changes, the effective impedance of the networks change instep and instantaneously to limit the antenna current(s) that exist above those networks; therefore, as the frequency of operation increases, the electrical height of the antenna in effect decreases. To accomplish this, a linear radiator 98 extends axially from the tank circuit 90 and is electrically connected to a heat dissipating ferrite/powder iron network 100. The network 100 includes at least one ferrite core 102 axially disposed over the linear radiator 98. Interposed between an inner diameter of the core 102 and an outer diameter of the radiator 98 is an inner heat dissipating medium 104. The medium 104 may be configured in any number of ways and includes but is not limited to a heat-conductive paste, a heat-conductive tape, a ceramic tube comprising Beryllium-Oxide, or other such material that intervenes the space between the inside of the toroidal core and the outside of the antenna element to carry the heat to the radiator 98 which is usually a brass tube, which acts as an effective heat-sink over the entire length of the antenna. The heat dissipating medium also assists in positioning the core in a desired linear position from the transformer 50.

The proper heat dissipating medium type and thickness or gap is selected through an "iterative selection process" that minimizes parasitic side-effects while maximizing heat transfer effectiveness. It will be appreciated that the medium 104 may extend along the length of the radiator past the ends of the core or cores 102. The extended length is believed to assist in further dissipating heat generated by the core 102 during operation of the antenna. To further dissipate the heat an additional and separate outer heat dissipative medium 106 may be disposed over the core or cores 102 and the medium 104. The medium 106 covers the outer diameter or surface of the core or cores 102. As such, excess heat generated by the core 102 that emanates outwardly is transferred by the medium 106 on to the adjacent linear radiator(s). In an exemplary embodiment, the medium 106 is an adhesive and encapsulant-lined dual-wall shrink tube such as provided by Tyco Raychem. In addition to providing a heat sink feature, the tubing positions and protects the network from impact forces experienced with a tactical antenna of this type in its application. In some embodiments just the outer heat dissipative medium 106 may be employed.

The aforementioned iterative process consists of putting candidate networks with the associated heat dissipative structure into a transmission line test fixture connected to a Vector-Network Analyzer (VNA) calibrated to measure the "S21" transmission parameter. The fixture establishes a "stable" TEM01 radiation mode in the presence of the candidate network, allowing "curve-fitting" or matching of the candidate network to an ideal (computer-generated) transmission scatter parameter S21 of an "ideal" resistor-inductor. The importance of these networks can be appreciated by the fact that by their proper selection, they allow a designer to control the overall antenna current profile as a function of applied frequency. The integral of this current results in the far-field radiation pattern of the antenna system 10. Further, the refined optimization process described above has effectively eliminated the need for expensive solid brass heat sinks that are deployed over the length of the antenna 10 in the design of the prior art, and thus the need for labor intensive soldering to affix these heat sinks to the brass tubes making up the antenna 10. This antenna 10 is thus simpler to build and very cost effective compared to the prior art. And the antenna 10 provides near exact matching of the prior art antenna system if needed by the end user as shown in this application or, improved, performance over the prior art by allowing the optimization of sub-bands of frequencies within the overall bandwidth. The lower VHF band can be optimized compared to the higher UHF or visa-versa for both gain and VSWR (Matching) by establishing "target" antenna current profiles from antenna modeling software that model a desired far-field radiation pattern.

Extending vertically from the network 100 is another linear radiator 110 which may have connected to its opposite end another heat dissipating ferrite/powder iron network 112. The network 112 is configured in much the same manner as the network 100 and includes at least one ferrite core 114 and an inner heat dissipating medium 116. An outer heat dissipating medium 118, much like the medium 106, may be disposed over the core or cores 114 and the medium 116. In some embodiments, just the medium 118 may be disposed over the cores 114. The networks 100 and 112 may be spaced apart and positioned a predetermined distance from one another so as to achieve the desired operational performance through precise antenna current control. Any number of cores 102, 114 could be used to obtain the desired operational performance. In one embodiment, two cores of TDK (Garden City, N.Y.) HF 40 T are used for the network 100 and two cores of TDK HF 40 T are used for the network 112. In another embodiment, five cores of Amidon (Costa Mesa, Calif.) FT-61 are used for the network 100 and four cores of FT-61 are used for the network 112. As will be appreciated, the composition of the ferrite beads is basically an iron oxide combined with a binder of compounds such as nickel, manganese, zinc or magnesium that make up each bead. Use of particular materials is selected based upon the desired operational properties of the antenna 10.

Axially extending from the network 112 is another linear radiator 120. Those skilled in the art will appreciate that the linear radiators 84, 98, 110, and 120 are typically brass tubes. In the preferred embodiment, the brass tube radiators have an outer diameter of 0.500 inches with a 0.014 inch wall thickness. Alternatively, the radiators 84, 98, 110 and 120 could be constructed of a plurality of wires or conductors braided or spirally served around a core of dielectric material.

A "top hat" 122 extends radially from an end of the radiator 120. The top hat 120 includes a shortened axially extending conductive tube 121 extending from a distal end of the radiator 120 that terminates at a plurality of radially extending conductive arms 126. The tube and arms may be encapsulated by a radome and/or protective tubing. In one embodiment 6 arms are utilized, but any number of arms could be provided.

Positioning of the networks is obtained by the frictional interface between the radiators, the selected heat dissipative medium and the core. Network positioning may also be achieved by use of adhesives or mechanical clamping devices. And, as previously noted, the mediums 106/118 can serve to position and protect their respective networks. Indeed, either or both of the inner and outer heat dissipative mediums create an envelope around the ferrite/powder iron networks extending above and below the networks contacting the linear radiator at the terminus of the networks.

Positioning of the networks may be adjusted so as to obtain a desirable VSWR and/or gain characteristic of the antenna 10. Once the networks are positioned and assembled on the radiators, the assembly is inserted into a radome and a foam material is received therein. The foam material expands and holds the networks and any other components in place. Various methods may be used to encase the components in the foam material. If desired, ferrules or other retaining features may be used to secure the positioning of the networks.

With the foregoing structure of the antenna portion 14, it will be appreciated that the networks 100 and 112, along with their positional placement along the radiators provide the effective electrical lengths and current distribution changes needed to obtain the desired bandwidth of the antenna portion 14.

It will be appreciated that as the frequency of the operation changes, the effective impedance of the networks 100 and 112 change instep and instantaneously in a way to limit the antenna current(s) that exist above those networks. Therefore, as the frequency of operation increases, the electrical height of the antenna 10 effectively decreases. It will be appreciated by those skilled in the art that positional adjustment of the networks within the antenna matching network 12 and changes to the values in the tank circuit 90, and the networks 100 and 112 correspondingly adjust the antenna's performance within the desired operating band. Of course, additional networks could be positioned along the length of the antenna. In one embodiment, the network 100 is positioned about 30 inches from the mounting plane and network 112 is positioned about 42 inches from the mounting plane. Accordingly, a change of network values and their placement along the antenna portion 14 could be adjusted such that the radiator pattern maximum load could be elevated (not along the line of sight) for ground to satellite communication.

Extending from the first antenna portion 14 or the VHF/UHF portion is the L-Band antenna portion 16. The antenna portion 16 is connected to the antenna portion 14 by a connector 130. In essence, the inner conductor 72 has passed through the portion 14 and is now utilized to radiate from the antenna portion 16. In other words, the inner conductor 72 feeds the antenna portion 16. The antenna portion 16 includes multi-element biconnical arrays in the form of a proximal array 132*a* and a distal array 132*b*. A conductor 131, which electrically extends from the connector 130, feeds into a splitter 138 which provides for a proximal feed 140 and distal feed 142. The proximal feed 140 is directed into the proximal array 132*a* while the distal feed 142 is directed into the distal array 132*b*. Skilled artisans will appreciate that the feeds 140 and 142 are substantially the same lengths so as to provide a desired electrical performance for the L-Band antenna portion of the antenna.

Figure 3:
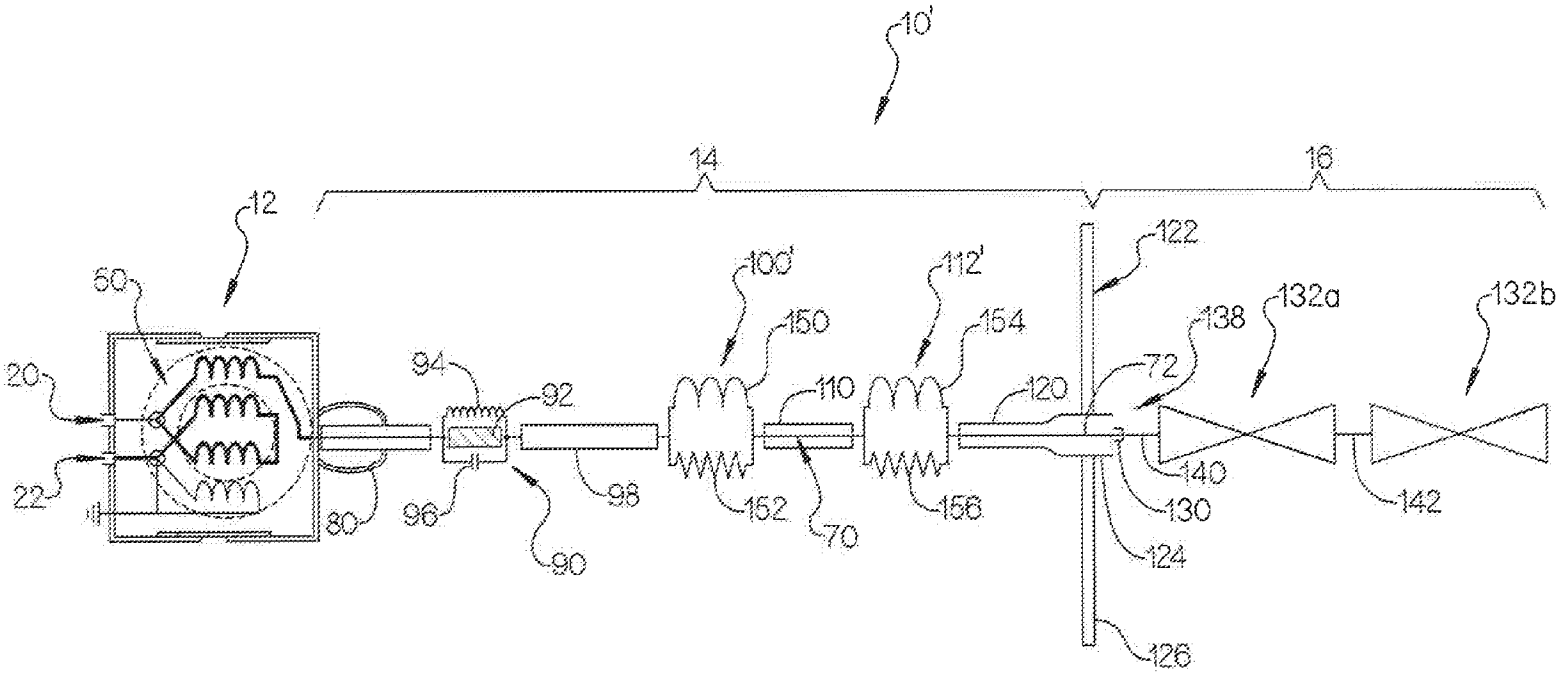
FIG. 3 is an alternative embodiment of a wide band tactical vehicular antenna system made in accordance with the concepts of the present invention.

Referring now to FIG. 3, it can be seen that an alternative embodiment is designated generally by the numeral 10'. This embodiment is substantially the same as the embodiment shown in FIG. 1 except for the configuration of the networks 100 and 112. Instead of utilizing ferrite/powder iron networks, the networks are replaced by inductor/resistor networks.

Extending axially from the antenna matching network 12 are a series of linear radiators and electrical component networks which function in such a manner that as the frequency of operation changes, the impedance of the networks change instep and instantaneously to limit the antenna current(s) that exist above those networks; therefore, as the frequency of operation increases, the electrical height of the antenna in effect decreases. To accomplish this, antenna portion 14 includes a linear radiator 98 extending axially from the tank circuit 90 and which is electrically connected to an inductor-resistor network 100'. The network 100' includes an inductor 150 and a resistor 152 connected in parallel. In the preferred embodiment, the inductor 150 has a value of 0.39 μH and a Q value of about 93 at 25 MHz. The preferred value for the resistor 50 is 250 ohms rated at 20 watts, VSWR 1.15:1, frequency DC to 3.0 GHz, and capacitance 1.2 pf.

Extending vertically from network 100' is another linear radiator 110 which has connected to its opposite end an inductor-resistor network 112'. The network 112' includes an inductor 154 and a resistor 156 connected in parallel. In this embodiment, the inductor 154 has a value of 0.57 μH and a Q of 92 at 25 MHz. The resistor 156 has a value of 150 ohms rated at 20 watts, VSWR of 1.15:1, frequency DC to 3.0 GHz, and capacitance 1.2 pf. Vertically extending from the network 112' is another linear radiator 120. As in the previous embodiment, the L-Band portion 16 extends from the radiator 120 and operates the same as in the previous embodiment.

Figure 4:
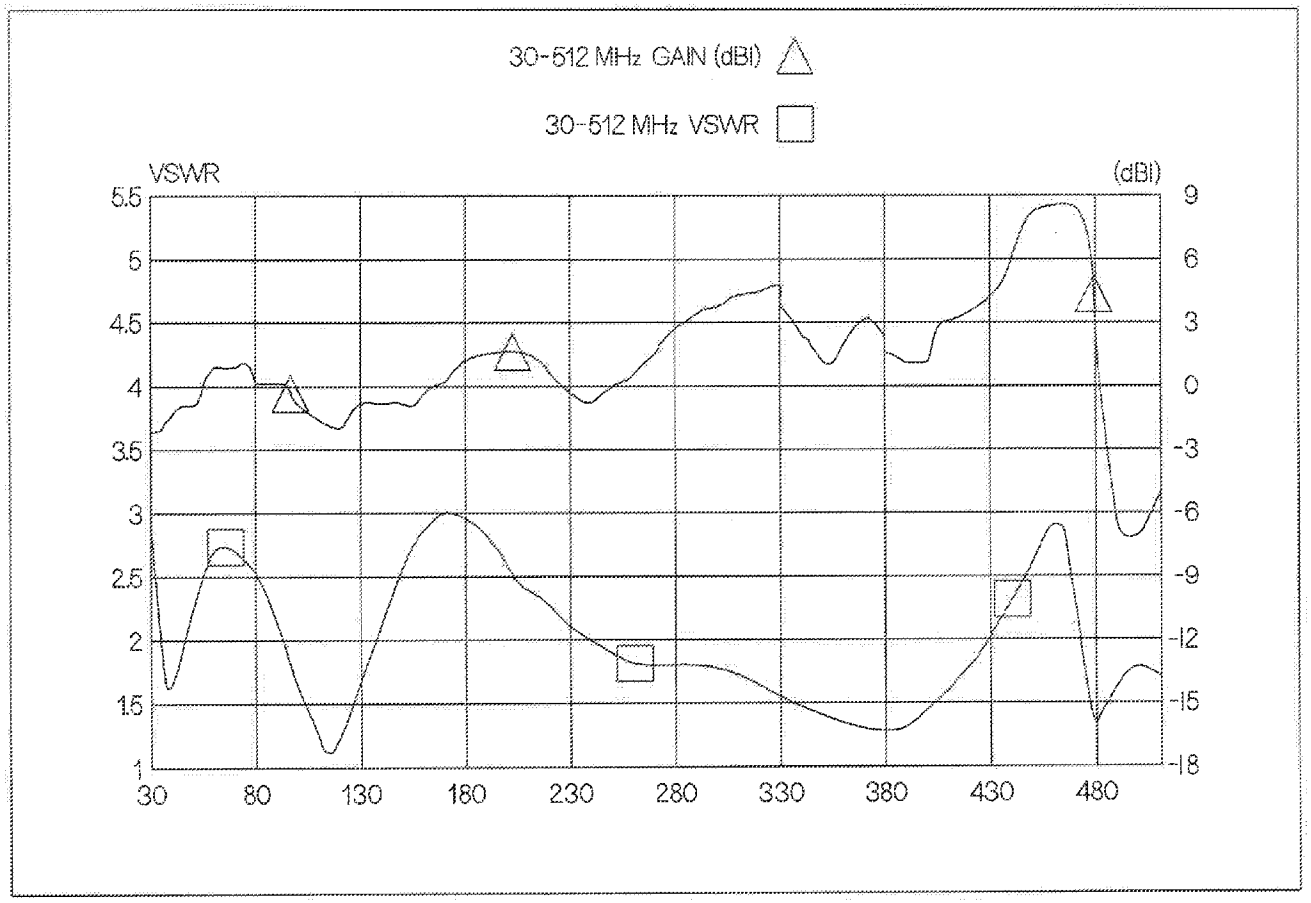
FIG. 4 is a plot of both gain and VSWR for 30 to 512 to Hz for a first antenna portion of the antenna system according to the concepts of the present invention.
Figure 5:
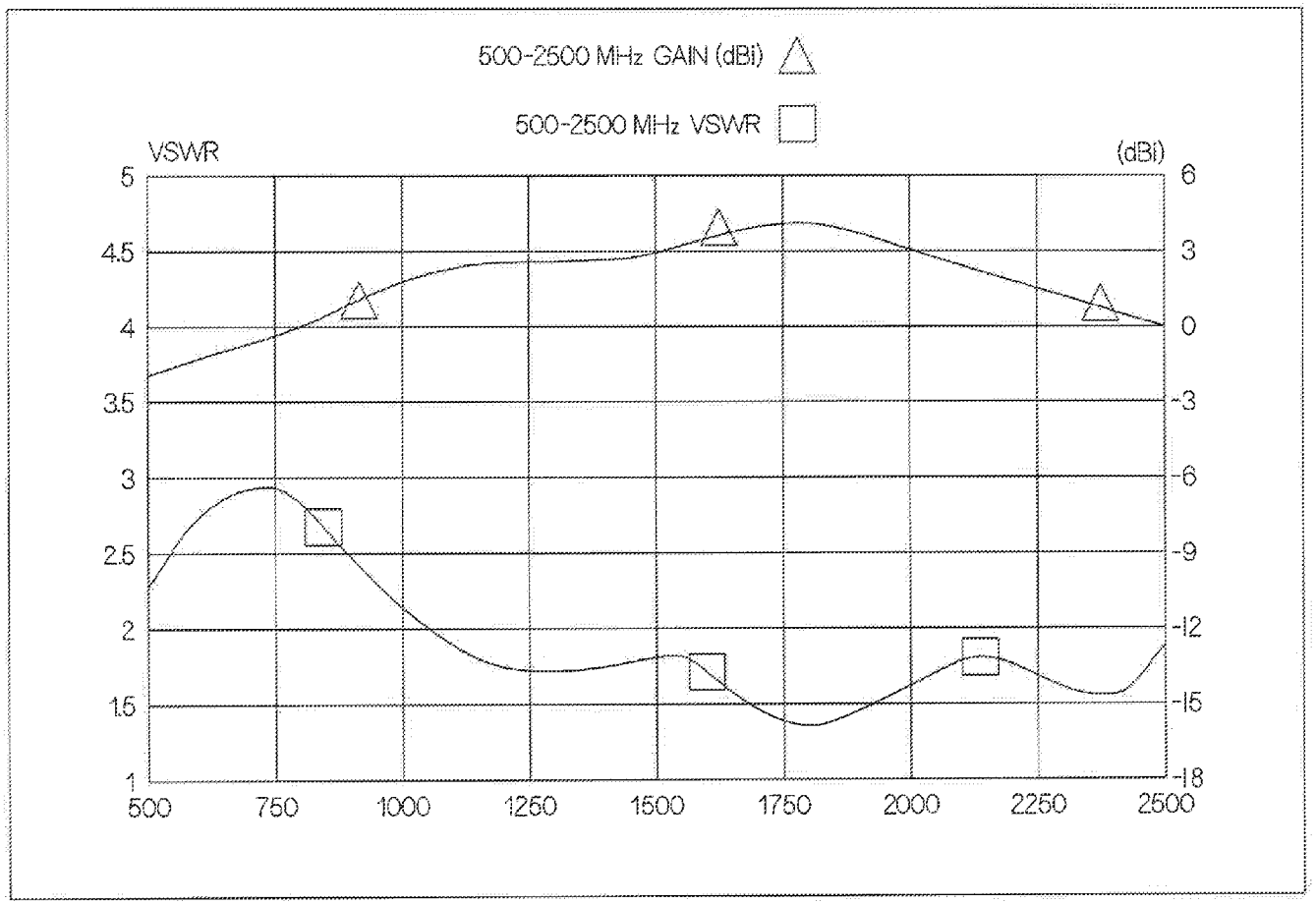
FIG. 5 is a plot of both gain and VSWR for 500 to 2500 Hz for a second antenna portion of the antenna system according to the concepts of the present invention.

Referring now to FIGS. 4 and 5 it can be seen that the gain and VSWR characteristics are provided for the first and second antenna portions 14, 16 as shown.

From the foregoing, the advantages of the present invention are readily apparent. The use of coaxial cable 30 in the antenna matching network 12 does not alter the original performance of the 50:200 (1:4) Ohm Guanella (current) transformer 50, which is configured for "Un/Un," Unbalanced source (transmitter) to Unbalanced load (antenna.). The Guanella transformer 50 is in fact a "transmission line" transformer where its windings are wound in "pairs," like the pairs of parallel conductors that make up a twin lead transmission line. One of the conductors making up the pair is actually a coaxial line which is electrically independent in signal path function (L-Band) and internal to the coaxial cable, while the (VHF/UHF) signal path is trapped between the pairs of conductors making up the transformer 50 where the outside shield braid of the coaxial cable 30 acts to function as one of the parallel wire conductors. The original prior art matching transformer consists of "paired" windings. The novel transformer has one member of this pair be an appropriate sized coaxial cable. Again, the shield of this coaxial cable acts as a barrier to keep L-Band signals inside while the outside of the shield acts as one pair of the twin pair for VHF/UHF signal transport. Finally the transformer impedance effect is also outside this coaxial line, as such, no impedance transformation occurs inside this coaxial line. Further this process can be extended to parallel Inductor-Capacitor (Traps), and parallel Inductor-Resistor networks to provide an entire means of a basic feed-network that make up the antenna system 10.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

These and other objects of the present invention, as well as the advantages thereof over existing prior art forms, which will become apparent from the description to follow, are accomplished by the improvements hereinafter described and claimed.

What is claimed is:

1. An antenna system comprising:

a first antenna portion operating over a first range of frequencies;

a second antenna portion operating over a second range of frequencies;

an antenna matching network comprising:

a housing having a ground portion and an output portion;

a housing insulator separating said ground portion from said output portion;

an unbalanced-unbalanced matching transformer comprising a ferrite core maintained in said housing; and a ground lead; and a transmission line comprising a single conductor and a coaxial cable, said coaxial cable having an inner conductor insulated from an outer conductor, wherein said first antenna portion is fed by said single conductor and said outer conductor, and said second antenna portion is fed by said inner conductor, wherein said ground lead and said outer conductor are connected to said ground portion, wherein said single conductor is connected to said outer conductor of said coaxial cable, wherein said ground lead is connected to said outer conductor of said coaxial cable, wherein said coaxial cable and said ground lead are wrapped around said ferrite core, wherein said outer conductor is connected to said output portion, and wherein said inner conductor passes through said output portion.

2. The antenna system according to claim 1, further comprising:

a tank circuit maintained by said first antenna portion to drop out selected frequencies emanating from said first antenna portion.

3. The antenna system according to claim 1, wherein said first antenna portion comprises at least one network such that as the frequency of operation changes, the effective impedance of the network changes to limit the antenna currents that exist above the network.

4. The antenna system according to claim 3, wherein said first antenna portion further comprises a plurality of radially extending arms at an end opposite said housing.

5. The antenna system according to claim 1, wherein said second antenna portion comprises at least one biconic antenna fed by said inner conductor.

6. The antenna system according to claim 1, wherein said first range of frequencies is 30 to 512 MHZ.

7. The antenna system according to claim 1, wherein said second range of frequencies is 500 to 2500 MHZ.

8. A method, comprising:

providing a housing having a ground portion and an output portion separated by a housing insulator;

maintaining an antenna matching network having a ground lead and an unbalanced-unbalanced matching transformer having a ferrite core in said housing;

connecting a transmission line to said antenna matching network, said transmission line comprising a single conductor and a coaxial cable, said coaxial cable having an inner conductor insulated from an outer conductor;

connecting said single conductor to said outer conductor;

connecting said ground lead in said antenna matching network to said ground portion and said outer conductor;

wrapping said ground lead and said outer conductor around said ferrite core of said unbalanced-unbalanced matching transformer;

connecting said outer conductor to said output portion;

passing said inner conductor through said output portion;

feeding a first antenna portion by said single conductor and said outer conductor, said first antenna portion operating over a first range of frequencies; and feeding a second antenna portion by said inner conductor, said second antenna portion operating over a second range of frequencies.

9. The method of claim 8, further comprising;

maintaining a tank circuit by said first antenna portion to drop out selected frequencies emanating from said first antenna portion.

10. The method of claim 8, further comprising:

using at least one network of said first antenna portion such that as the frequency of operation changes, the effective impedance of the network changes to limit the antenna currents that exist above the network.

11. The method of claim 10, wherein said first antenna portion further comprises a plurality of radially extending arms at an end opposite said housing.

12. The method of claim 11, further comprising:

feeding at least one biconic antenna of said second antenna portion by said inner conductor.

13. An antenna system, comprising:

a transmission line comprising a coaxial cable having an outer conductor that surrounds an insulator which surrounds an inner conductor, and a single conductor, wherein said single conductor is connected to said outer conductor;

a housing receiving said transmission line wherein said housing comprises a ground portion;

an output portion; and a housing insulator separating said ground portion from said output portion, wherein a ground lead and said outer conductor are connected to said ground portion and wherein said outer conductor is connected to said output portion and said inner conductor passes through said output portion;

an antenna matching network maintained in said housing, said network having a Guanella unbalanced-unbalanced matching transformer comprising a ferrite core with said coaxial cable and connected single conductor wrapped around said ferrite core to form transformer windings;

a first antenna portion connected to said antenna matching network, wherein said first antenna portion is fed by said Guanella unbalanced-unbalanced matching transformer with said outer conductor and said single conductor; and a second antenna portion extending from said first antenna portion, wherein said inner conductor passes through said first antenna portion to feed said second antenna portion.

14. The antenna system according to claim 13, further comprising:

a tank circuit maintained by said first antenna portion to drop out selected frequencies emanating from said first antenna portion.

15. The antenna system according to claim 13, wherein said first antenna portion comprises at least one network such that as the frequency of operation changes, the effective impedance of the network changes to limit the antenna currents that exist above the network.

16. The antenna system according to claim 13, wherein said second antenna portion comprises at least one biconic antenna fed by said inner conductor.

17. The antenna system according to claim 13, wherein said outer conductor and said connected single conductor carries a VHF/UHF signal and said inner conductor carries an L-Band signal that is effectively hidden from the operation of said VHF/UHF signal.

18. The antenna system according to claim 17, wherein said outer conductor acts as a barrier to keep said L-Band signal in said coaxial cable.

19. The antenna system according to claim 13, wherein said ground lead is wrapped a selected number of times around said ferrite core.

* * * * *